US007973631B2

(12) United States Patent
Götsch et al.

(10) Patent No.: US 7,973,631 B2
(45) Date of Patent: Jul. 5, 2011

(54) INDUCTIVE COMPONENT AND METHOD FOR MANUFACTURING AN INDUCTIVE COMPONENT

(75) Inventors: Dieter Götsch, Ottobrunn (DE); Richard Matz, Bruckmühl (DE); Ruth Männer, Oberpframmem (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 247 days.

(21) Appl. No.: 12/300,909

(22) PCT Filed: May 3, 2007

(86) PCT No.: PCT/EP2007/054285

§ 371 (c)(1),
(2), (4) Date: Nov. 14, 2008

(87) PCT Pub. No.: WO2007/131884

PCT Pub. Date: Nov. 22, 2007

(65) Prior Publication Data

US 2009/0102591 A1 Apr. 23, 2009

(30) Foreign Application Priority Data

May 16, 2006 (DE) ..... 10 2006 022 785

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS

| | | | | |
|---|---|---|---|---|
| 5,349,743 | A | 9/1994 | Grader et al. | |
| 6,198,374 | B1 | 3/2001 | Abel | |
| 6,492,597 | B2 * | 12/2002 | Fujii et al. | 174/255 |
| 6,603,159 | B2 * | 8/2003 | Atobe et al. | 257/280 |
| 6,611,046 | B2 * | 8/2003 | Yang | 257/622 |
| 7,375,609 | B2 * | 5/2008 | Suzuki et al. | 336/200 |
| 7,528,523 | B2 * | 5/2009 | Aoki | 310/313 R |
| 7,579,629 | B2 * | 8/2009 | Inoguchi | 257/98 |
| 2007/0030659 | A1 | 2/2007 | Suzuki et al. | |

FOREIGN PATENT DOCUMENTS

| | | |
|---|---|---|
| EP | 0 782 154 | 7/1997 |
| EP | 1 168 384 | 1/2002 |
| EP | 1 168 386 | 1/2002 |
| EP | 1 211 701 | 6/2002 |
| GB | 2 083 952 | 3/1982 |
| WO | WO 2005/032226 | 4/2005 |

* cited by examiner

*Primary Examiner* — Anh T Mai
*Assistant Examiner* — Joselito Baisa
(74) *Attorney, Agent, or Firm* — Cohen Pontani Lieberman & Pavane LLP

(57) ABSTRACT

A method for manufacturing an inductive component which is formed from a plurality of layers, wherein the method comprises the steps of a) arrangement of an electrically conductive material as a winding of the component on a first non-magnetic, dielectric ceramic layer; b) formation of at least one cutout which passes all the way through in the non-magnetic, dielectric ceramic layer; c) arrangement of a first magnetic ceramic layer on an upper face and a second magnetic ceramic layer on a lower face of the non-magnetic, dielectric ceramic layer; and d) carrying out a process step in which at least one of the magnetic ceramic layers is plastically deformed such that contact is made with the two magnetic ceramic layers in the area of the cutout, and the two magnetic ceramic layers form a magnetic core of the component.

26 Claims, 4 Drawing Sheets

INDUCTIVE COMPONENT AND METHOD FOR MANUFACTURING AN INDUCTIVE COMPONENT

RELATED APPLICATIONS

This is a U.S. national stage of application No. PCT/EP2007/054285, filed on May 3, 2007. This application claims the priority of German application No. 10 2006 022 785.9 filed on May 16, 2006, the entire content of which is hereby incorporated by reference.

FIELD OF THE INVENTION

The present invention relates to a method for manufacturing an inductive component which is formed from a plurality of layers. The invention also relates to an inductive component such as this.

BACKGROUND OF THE INVENTION

Static magnetic apparatuses, for example transformers and inductors, are major elements of circuits which are designed for storage and conversion of energy, for impedance matching, for filtering, for suppression of electromagnetic interference radiation or else for voltage or current conversion. Furthermore, these components are also major components of resonant circuits. Inductive components are based on the production of magnetic alternating fields by primary currents, which themselves induce secondary currents. They can therefore be manufactured for high frequencies with acceptable compactness and efficiency, without magnetic materials, by suitable arrangement of the current paths. For miniaturization, partially planar windings, which can be integrated in conventional multilayer circuit mounts composed of organic or ceramic materials, have been proven over wire-wound, relatively costly components. In this case, in particular, the widely used circuit mounts composed of FR4 material or LTCC (Low Temperature Cofired Ceramic) technology may be mentioned. In this technology, unsintered ceramic green films are provided with vias and planar line structures by stamping and screen printing methods using metal-filled, electrically conductive pastes, and are then sintered together in a stack. This results in substrates which can be thermally loaded, have low losses, are hermetically sealed and can be populated further in a conventional manner.

For the wide field of application of current and voltage transformation, as well as for low-pass filters in power electronic circuits, the low frequencies result in a need for components with better magnetic coupling based on magnetic materials, which can reinforce and shape the magnetic flux. A wide range of variants of coil and transformer cores composed of ferritic ceramic are commercially available for this purpose and can be subsequently attached, with the aid of metal brackets, to the planar circuit mounts that have been mentioned.

It has not yet been possible for completely monolithic solutions, which promise more cost-effective manufacture in a blank, to become established, because of more far-reaching demands relating to material and process technology. One problem aspect in this case is that an increase in the magnetic performance of ferrites, that is to say the permeability of the material, with the aid of ceramic technologies results, from experience, in a decrease in their resistivity and therefore a decrease in the important DC voltage isolation between the primary and secondary sides of the transformer. In order to counteract this, it is in principle possible to embed turns which carry the current in material which provides good insulation and has low permeability. This corresponds to the wire insulation and air in the case of wire-wound components.

The two spatial regions with high magnetic permeability on the one hand and good insulation of the turns on the other hand are illustrated in the basic form in FIG. 1. This figure shows a toroidal core 1, which is ringed on the one hand by a primary winding 2 and on the other hand by a secondary winding 3. FIG. 2 shows a further basic refinement in which two toroidal cores 1*a* and 1*b* are provided, which are arranged alongside one another in the horizontal direction, with both toroidal cores 1*a* and 1*b* being ringed by a primary winding 2 and a secondary winding 3, which are arranged one on top of the other horizontally.

FIG. 3 shows a section illustration on the plane of the primary winding 2, as shown in the illustration in FIG. 2. The winding 2 is in this case shown by dashed lines and surrounds a central area 11 of the ferrite core, which is formed by the toroidal cores 1*a* and 1*b*. The toroidal cores 1*a* and 1*b* form a ferrite core of the inductive component. The vertical ferrite limbs which are shown in the section illustration are closed by ferrite covering layers on the upper face and lower face to form these toroidal cores 1*a* and 1*b*. The windings 2 and 3 as well as the toroidal cores 1*a* and 1*b* are embedded in a dielectric 4.

FIG. 4 shows a further section illustration, illustrating an approximation to a pot-type core with five vertical limbs composed of ferrite material. The limbs are characterized by the central area 11 and the vertical outer limbs 1*a*, 1*b*, 1*c* and 1*d*. In this case as well, the arrangement is embedded in an insulating dielectric medium.

U.S. Pat. No. 5,349,743 discloses a method for manufacturing a monolithically integrated planar transformer based on LTCC technology. The basic structures shown in FIGS. 1 and 2 are in this case manufactured by connection of a material with low permeability with a relatively high resistivity and of a material with a higher permeability and a lower resistivity. These two materials are integrated by stamping out openings in the films of one material, filling the openings with film pieces or film stacks of the other material, and then sintering them jointly. This inlaying process is complex and susceptible to errors, even with materials which are well matched to one another, and is therefore also relatively expensive, since the films must be processed abutting.

Furthermore, U.S. Pat. No. 6,198,374 discloses a method based on conventional LTCC technology. In this method, just one film type, specifically that composed of the most suitable ferrite, is used in order to print on the conductor tracks. These are then coated, for example by screen printing, with non-magnetic, dielectric material. The aim of this is to reduce the effective permeability and the stray inductance, caused by leakage of field lines, in the vicinity of the turns of a winding. An additional aim is in this way to improve the electrical insulation between the turns. This has the disadvantage of the additional material layer in the area of the turns, which cannot be chosen to be indefinitely thick, in order to avoid stress cracking. In particular, the conductor tracks themselves must actually be made as thick as possible for power-electronic applications, in order to reduce resistance losses. The known method therefore offers only restricted effectiveness.

SUMMARY OF THE INVENTION

One object of the present invention is to provide a method which allows an inductive component with a high withstand voltage to be manufactured at low cost. A further object is also to provide an inductive component such as this.

One aspect of the invention is directed to a method for manufacturing an inductive component, this component is formed from a plurality of layers. In this case, an electrically conductive material is arranged as a turn or winding of the component on a first non-magnetic, dielectric ceramic layer. Furthermore, at least one cutout which passes all the way through is formed in the non-magnetic, dielectric ceramic layer. A first magnetic ceramic layer or a corresponding layer stack is or are arranged on an upper face of this non-magnetic, dielectric ceramic layer. A separate second magnetic ceramic layer or a corresponding layer stack is or are arranged on a lower face of the non-magnetic, dielectric ceramic layer. This intermediate state of the inductive component created in this way is then subjected to at least one further process step, in which at least one of the magnetic ceramic layers is plastically deformed such that contact is made with the two magnetic ceramic layers in the area of the cutout, forming a magnetic core of the component. The method allows an inductive component to be produced with little effort, and therefore in a cost-effective manner as well. The inductive component may in this case be produced with an optimized withstand voltage between the turns or the windings of the inductive component. The sequence of the process steps is not fixed by the listing mentioned above. In particular, the two first-mentioned steps can also be carried out in the opposite sequence.

The electrically conductive material is preferably embedded in or printed onto the non-magnetic, dielectric ceramic layer. The non-magnetic, dielectric ceramic layer and the magnetic ceramic layers are preferably provided as films.

The dimensions of the cutout on the plane of the ceramic layer are greater than the thickness of the ceramic layer.

In comparison to the prior art, the turns or windings are therefore preferably conventionally embedded in or at least printed onto the non-magnetic, dielectric ceramic layer. Experience has shown that numbers of layers from 5 to 10 are sufficient for a multiplicity of applications and thus results in a relatively thin material thickness of the overall inductive component of a few hundred μm. In order to allow a magnetic through-contact to be implemented, at least one non-magnetic, dielectric ceramic layer is provided with preferably stamped openings whose extent is large in comparison to the material thickness of the multilayer. For example, it is possible in this case to provide a cutout with a diameter of between 1 mm and 3 mm, preferably about 2 mm.

At least one closed covering film composed of ferrite is then preferably subsequently laminated in an advantageous manner onto the upper face and the lower face of this non-magnetic, dielectric ceramic layer.

In this case, these magnetic ceramic layers can be applied directly onto the electrically conductive materials and thus onto the connections and/or windings, and onto the upper face and the lower face of the non-magnetic, dielectric ceramic layer. It is also possible for the turns or windings to be covered by a further non-magnetic, dielectric ceramic layer and thus to be essentially completely surrounded by non-magnetic, dielectric material. No direct connection to the magnetic ceramic layers is envisaged in this refinement.

The process step for plastic deformation of at least one magnetic ceramic layer is advantageously carried out as a sintering process. This sintering process is carried out in such a way that the magnetic ceramic layers, which are preferably ferrite films, rest centrally on one another as a result of the plastic deformation caused by the softening of the glass component in the cutout of the non-magnetic, dielectric ceramic material. Both magnetic ceramic layers are preferably deformed during this sintering process. In practice, this makes it possible to produce a magnetic via with a sufficiently large cross section, closing the magnetic flux circuit. The magnetic ceramic layers can therefore be used to form a magnetic core for the component, in an optimized manner.

A coating can advantageously be applied during this sintering process at least to one magnetic ceramic layer, and is arranged in order to assist the deformation of this ceramic layer. A coating such as this allows the deformation to be carried out at a precise position, improving the deformation of the magnetic ceramic layers into the cutout and therefore also the contact with the two magnetic ceramic layers. The contact area between the two magnetic ceramic layers can thus be made as large as possible.

A plurality of non-magnetic, dielectric layers are preferably stacked, with at least one cutout being formed in each of the non-magnetic, dielectric ceramic layers, and with the non-magnetic, dielectric ceramic layers being arranged one on top of the other such that these cutouts overlap, at least in places. A cutout is formed in a preferred manner in a non-magnetic, dielectric ceramic layer with different dimensions to a cutout in an at least second non-magnetic, dielectric ceramic layer. The non-magnetic, dielectric ceramic layers are then preferably stacked such that a cutout which passes all the way through all the non-magnetic, dielectric ceramic layers is designed to taper at least in places. A cutout is illustrated in a preferred manner in a section illustration of an inductive component which has been manufactured in this way with a plurality of non-magnetic, dielectric ceramic layers, which cutout is designed such that it tapers initially, and then widens again. This taper and subsequent widening are preferably designed, in a cross-sectional illustration, such that the cutout which passes all the way through is formed symmetrically with respect to a horizontally arranged line of symmetry, in a cross-sectional illustration.

The taper is preferably formed with a stepped profile. Magnetic vias with a stepped profile offer a large amount of design freedom with respect to the number of dielectric and magnetic layers.

A magnetic material is preferably applied at least to one magnetic ceramic layer, with the magnetic ceramic layer being arranged on the non-magnetic, dielectric ceramic layer such that the magnetic material is positioned in the area of the cutout. The magnetic material is preferably applied with a structure which corresponds essentially to the inverse configuration of the tapered cutout of the plurality of stacked non-magnetic, dielectric ceramic layers. When there are more turns and a greater number of layers, a stepped design such as this in the area of this cutout avoids excessively small radii of curvature of the outer magnetic ceramic layers, in particular of the ferrite layers.

This magnetic material is preferably printed onto the magnetic ceramic layers. This preferably makes it possible to reduce the plastic deformation of the magnetic ceramic layers in the area of the cutout. This magnetic material is preferably printed on by means of a screen printing method, as a ferritic thick-film paste. In addition, ferrite paste can be printed repeatedly onto the magnetic ceramic layers, before the lamination process, in the area of the cutout, in order to allow the cutout to be closed completely, thus allowing it to be formed without an air gap.

At least two non-magnetic, dielectric ceramic layers are preferably formed, between which a magnetic layer, in particular a magnetic ceramic layer, is formed. This magnetic ceramic layer is preferably in the form of a continuous layer. This allows field line profiles to be adjusted deliberately. For example, this also allows field lines to escape at the side, without having to pass through all the turns. The magnitude of this stray inductance can be adjusted deliberately by the thickness of this additionally introduced magnetic ceramic layer.

In one refinement with only one non-magnetic, dielectric ceramic layer, the electrically conductive material can be designed to form turns on an upper face and on a lower face of this non-magnetic, dielectric ceramic layer.

The electrically conductive material can be arranged in order to form a primary winding and a secondary winding of the inductive component.

A non-magnetic, dielectric ceramic layer is preferably formed with a thickness of between 20 μm and 200 μm, in particular of between 50 μm and 100 μm. The conductor tracks or turns can be completely embedded in highly insulating, dielectric ceramic. Because of the high breakdown strength, these ceramic layers can be made correspondingly thinner, thus allowing costs to be saved, and the physical size to be minimized.

The inductive component is preferably in the form of a monolithically integrated planar transformer.

In the proposed method, the functions of magnetic permeability and electrical insulation are implemented in their respective spatial regions by respectively tailor-made specific ceramics, thus resulting in high effectiveness of the design and of the requirement and use of the component. In this case, different ceramics can be used, depending on the requirement. If the inductive component is intended to be used at high frequencies, for example in the range between 1 and 2 GHz, hexa-ferrite ceramics can preferably be used, in particular barium-hexa-ferrite ceramics. These have a permeability of between about 10 and 30.

A second class of ceramics can be used when frequencies are required in the medium range from about 10 to about 30 MHz. In this case, by way of example, CuNiZn-ferrite materials can be used. The permeability of ceramics, which are utilized for components for use in this medium frequency range, have permeability values from about 150 to about 500.

Furthermore, a further class of ceramics is envisaged, which are used for components in the relatively low frequency range between about 1 and about 3 MHz. In this case, by way of example, MnZn-ferrite materials can be used. Ceramics which are used in this class preferably have permeability values of between about 500 and 1000.

No mixed material with restricted performance is therefore used for the method according to the invention, as is done, by way of example, in the method of U.S. Pat. No. 6,198,374. Furthermore, no problematic process step is involved, as in the prior art according to U.S. Pat. No. 5,349,743.

Another aspect of the invention is directed to an inductive component formed from a plurality of layers, and in particular is in the form of a monolithically integrated planar transformer. The inductive component comprises at least one electrically conductive winding, which is arranged on a first non-magnetic, dielectric ceramic layer. At least one cutout, which passes all the way through, is formed in this at least one non-magnetic, dielectric ceramic layer. The inductive component furthermore comprises a first magnetic ceramic layer, which is arranged on an upper face of the non-magnetic, dielectric ceramic layer. Furthermore, a second magnetic ceramic layer is arranged on a lower face of this non-magnetic, dielectric ceramic layer. At least one of these two magnetic ceramic layers is plastically deformed in the area of the cutout such that it is connected to the other magnetic ceramic layer in the area of the cutout, and a magnetic core of the component is formed, overall, by these two ceramic layers. The inductive component which is produced in this way has an optimized withstand voltage between the turns and windings and, furthermore, can be manufactured cost-effectively.

BRIEF DESCRIPTION OF THE DRAWING(S)

DETAILED DESCRIPTION OF THE DRAWINGS

Identical and functionally identical elements are provided with the same reference symbols in the figures.

In this case, the expression "non-magnetic material" means a material which has a relative magnetic permeability close to or equal to unity in comparison to the magnetic material which is used for the magnetic ceramic layer.

Figure 1:
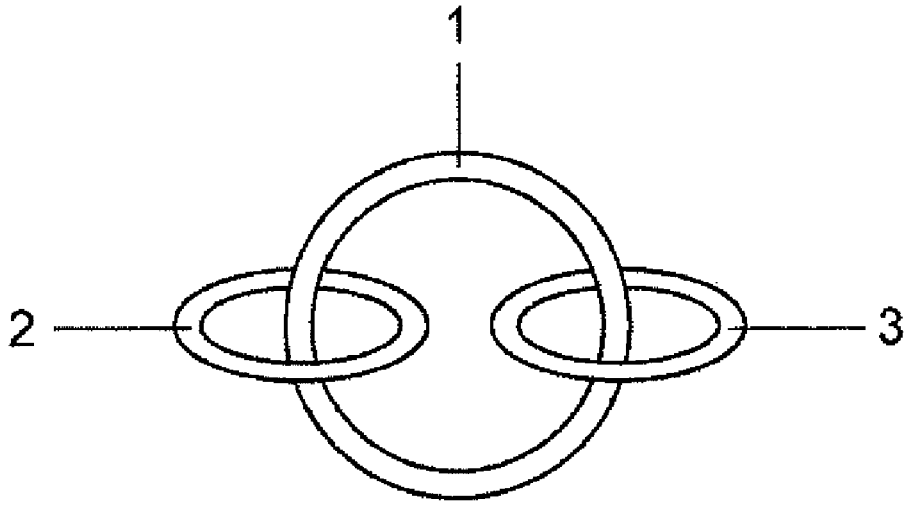
FIG. 1 shows a first basic structure of a transformer known in the prior art.
Figure 2:
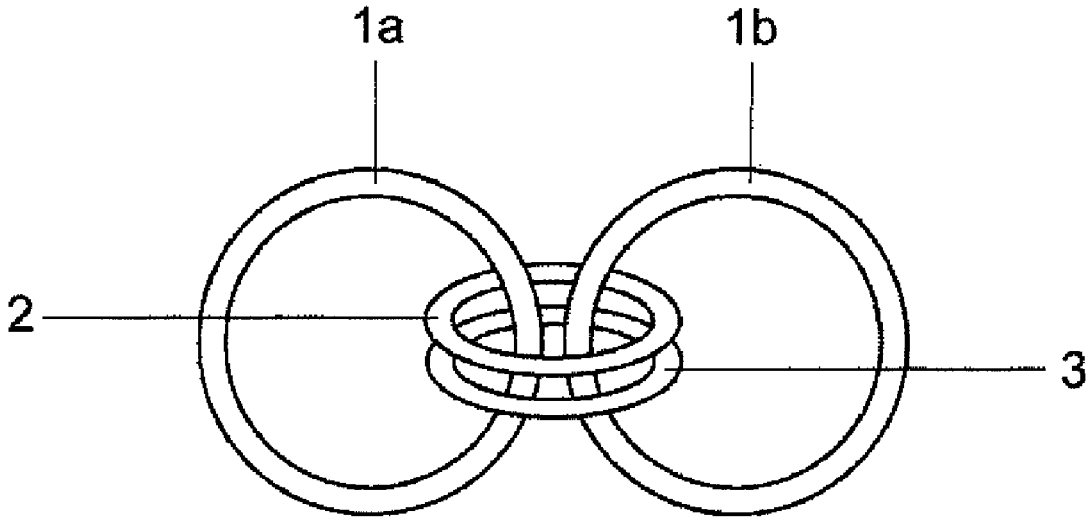
FIG. 2 shows a second basic structure of a transformer known in the prior art.
Figure 3:
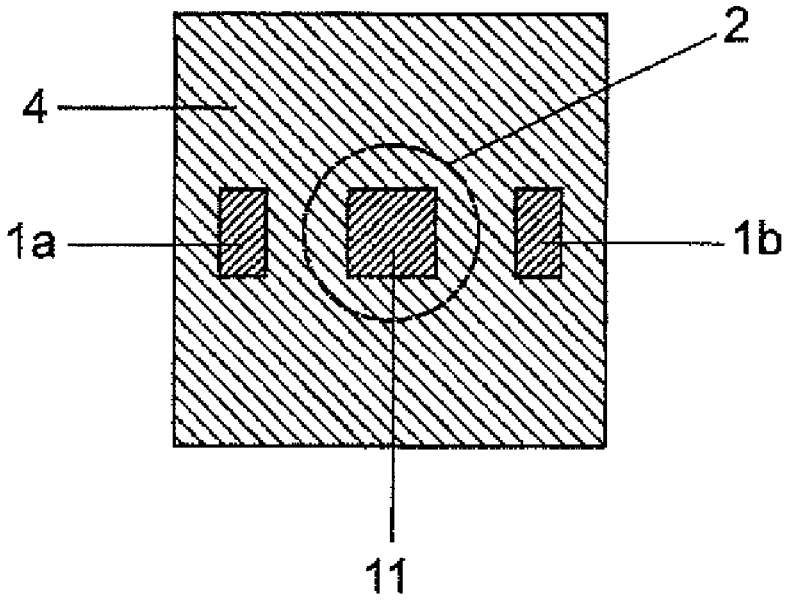
FIG. 3 shows a section illustration of the transformer shown in FIG. 2.
Figure 4:
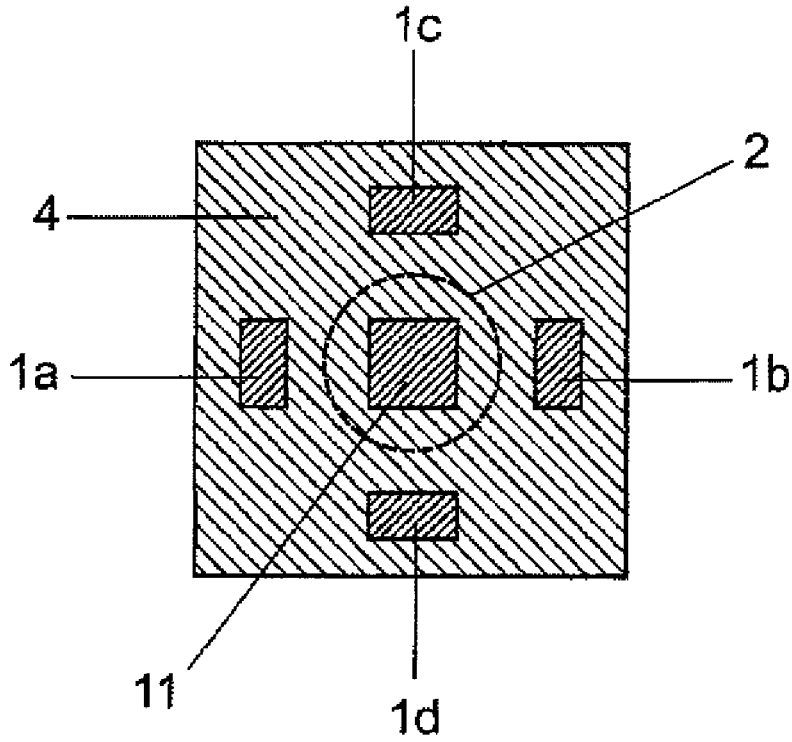
FIG. 4 shows a further section illustration through one embodiment of a transformer known in the prior art.
Figure 5:
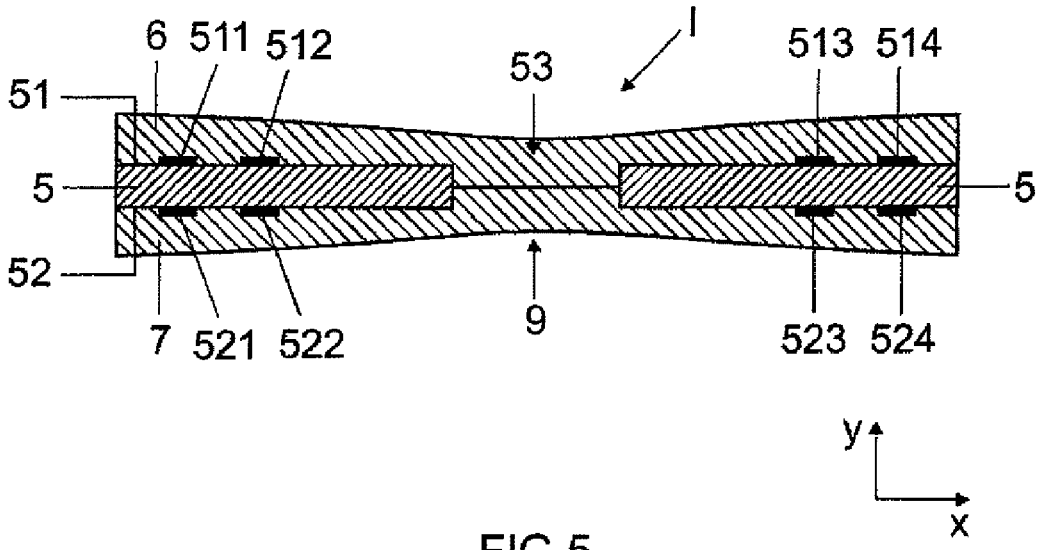
FIG. 5 shows a section illustration through a first exemplary embodiment of an inductive component according to the invention.

FIG. 5 shows a first exemplary embodiment of a completed monolithically integrated planar transformer I. The figure in this case shows a longitudinal section illustration through a layer stack, showing only that part of the planar transformer I which is essential for the invention. The section illustration shows a planar transformer I with a small number of turns, which was manufactured using LTCC technology. The planar transformer I has a non-magnetic, dielectric ceramic layer 5, which is in the form of a film. In the exemplary embodiment, intrinsically closed current-carrying conductor tracks or turns 511, 512, 513 and 514 are arranged on an upper face 51 of this dielectric ceramic layer 5, surround the transformer core in a specific turn sense, and represent turns of a primary winding of the planar transformer I. This primary winding has a spiral shape in a plan view illustration. Contacts are fitted to ends, which are not illustrated, of this winding, by means of which an electrical connection can be made to a power supply.

A secondary winding, which comprises the turns 521, 522, 523 and 524 is formed on a lower face 52 of the dielectric ceramic layer 5. This secondary winding also has ends which are intended for further electrical contact to be made. Both the turns 511 to 514 of the primary winding and the turns 521 to 524 of the secondary winding are printed in a conventional manner on the upper face 51 and on the lower face 52, respectively, of the dielectric ceramic layer 5.

Furthermore, the planar transformer I has a cutout 53 which passes all the way through and is produced by a stamping process.

In the illustrated exemplary embodiment, a first magnetic ceramic layer 6 is arranged on the upper face 51 and directly on the turns 511 to 514. A second magnetic ceramic layer 7 is likewise arranged on the lower face 52 and directly on the turns 521 to 524 of the secondary winding. In the area of the cutout 53, these two separate magnetic ceramic layers 6 and 7 are plastically deformed, and are connected to one another centrally. In practice, this results in a magnetic via being formed in the area of the cutout 53, by which means the two magnetic ceramic layers 6 and 7 form a magnetic core of the planar transformer I. For this purpose, the magnetic ceramic layers 6 and 7 also make contact with one another on the edge areas which face away from the cutout 53 in the x-direction. This contact on the edge areas is also formed by a plastic deformation of at least one of the ceramic layers 6 or 7. The indentations in the y-direction in the area of the cutout 53 which result from the plastic deformation of the ceramic layers 6 and 7 may, if required, be planarized by a subsequent doctor process. In this case, for example, a further dielectric paste can be applied at the appropriate points, and is formed flat by this doctor process.

The completed planar transformer I shown in FIG. 5 is designed such that the dielectric ceramic layer 5 is manufactured first of all and is prepared for further processing. The at least one cutout 53 is stamped out for this purpose. Furthermore, the electrically conductive material to form the turns 511 to 514 as well as the turns 521 to 524 is then printed onto the appropriate surfaces of this dielectric ceramic layer 5.

In the exemplary embodiment, the cutout is stamped out in the x-direction and in the z-direction (at right angles to the plane of the figure) with dimensions which are considerably greater than the thickness (y-direction) of the dielectric ceramic layer 5.

The two separately provided magnetic ceramic layers 6 and 7, which are provided as closed unburnt green films composed of ferrite, are then subsequently laminated onto the upper face 51 and the lower face 52 such that these ceramic layers 6 and 7 lie centrally on one another in the cutout 53 by a plastic deformation, as a result of their organic binding component. A central area 9 of the magnetic core of the planar transformer I is thus formed in the cutout. The sintering process is then carried out. In the exemplary embodiment, the plastic deformation thus takes place as a result of the lamination process. Instead of the layers 6 and 7, a stack comprising a plurality of magnetic layers can also be formed in each case, as appropriate for the requirements of the component.

Figure 6:
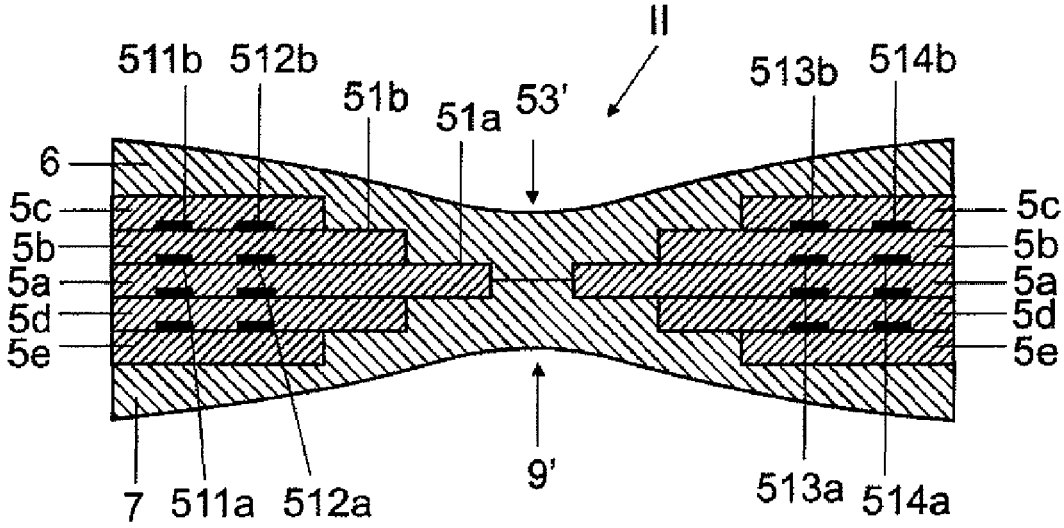
FIG. 6 shows a section illustration through a second exemplary embodiment of an inductive component according to the invention.

A further exemplary embodiment of a monolithically integrated planar transformer II, which has been manufactured using LTCC technology, is shown in FIG. 6. In this case as well the figure shows a longitudinal section illustration of a partial detail of a completed planar transformer II.

The section illustration shows a design of the planar transformer II which has a large number of turns.

The planar transformer II has non-magnetic dielectric ceramic layers 5*a*, 5*b*, 5*c*, 5*d* and 5*e*, which are arranged stacked one on top of the other. Turns are applied to the upper faces of each of the dielectric ceramic layers 5*a*, 5*b*, 5*d* and 5*e*. By way of example, the turns are in this case referred to as 511*b*, 512*b*, 513*b* and 514*b*, which are printed on an upper face 51*b* of the dielectric ceramic layer 5*b*. The turns 511*a*, 512*a*/513*a* and 514*a* are printed on an upper face 51*a* of the dielectric ceramic layer 5*a*. In the exemplary embodiment, these turns are associated with a primary winding of the planar transformer II. The turns, which are not identified in any more detail but are printed onto the dielectric ceramic layers 5*d* and 5*e*, are associated with a secondary winding of the planar transformer II. The turns can also be arranged such that one of the turns which is arranged on an upper face, for example on the upper face of the dielectric ceramic layer 5*a*, is associated in the x-direction with the primary winding, and, alternately, the next in the x-direction is associated with the secondary winding.

As can be seen from the illustration in FIG. 6, the dielectric ceramic layer 5*c* is arranged as a final covering layer on the dielectric ceramic layer 5*b*. The turns of the planar transformer II are thus completely surrounded by dielectric ceramic material.

In this case as well, magnetic ceramic layers 6 and 7 are laminated on the opposite faces of the stacked dielectric ceramic layer 5*a* to 5*e* and are plastically deformed in the area of a cutout 53' such that they are connected to one another in this area. In consequence, a central area 9' of the magnetic core of the planar transformer II is formed in this case as well.

As can be seen in this context, the stacked dielectric ceramic layers 5*a* to 5*e* each have cutouts which have different dimensions. The dielectric ceramic layers 5*a* to 5*e* are in this case stacked such that the respective individual cutouts which are formed in these ceramic layers form a common cutout 53' which passes all the way through. As can be seen in this case, the dielectric ceramic layer 5*c* in the illustrated section illustration has a cutout which is larger at least in the x-direction than the cutouts which are formed individually in the electrical ceramic layers 5*b*, 5*a* and 5*d*.

As can also be seen, the cutouts which are formed in the dielectric ceramic layers 5*b* and 5*d* are larger than the cutout which is formed in the dielectric ceramic layer 5*a*. In the exemplary embodiment, the dielectric ceramic layers 5*a* to 5*e* are stacked one on top of the other such that, starting from the upper dielectric ceramic layer 5*c* to the centrally arranged dielectric ceramic layer 5*a*, this results in a tapering cutout 53' in the y-direction. In this case, a stepped profile is provided in the exemplary embodiment. Starting from the central dielectric ceramic layer 5*a*, this cutout 53' widens in the y-direction again as far as the lower dielectric ceramic layer 5*e*. A stepped profile is formed in this case as well. In the exemplary embodiment, the planar transformer II is designed to be symmetrical in respect to an axis of symmetry which is drawn through the dielectric ceramic layer 5*a* in the x-direction.

The configuration according to the method of the planar transformer II which is illustrated in the completed state is preferably carried out analogously to the manufacture of the planar transformer I shown in FIG. 5.

Figure 7:
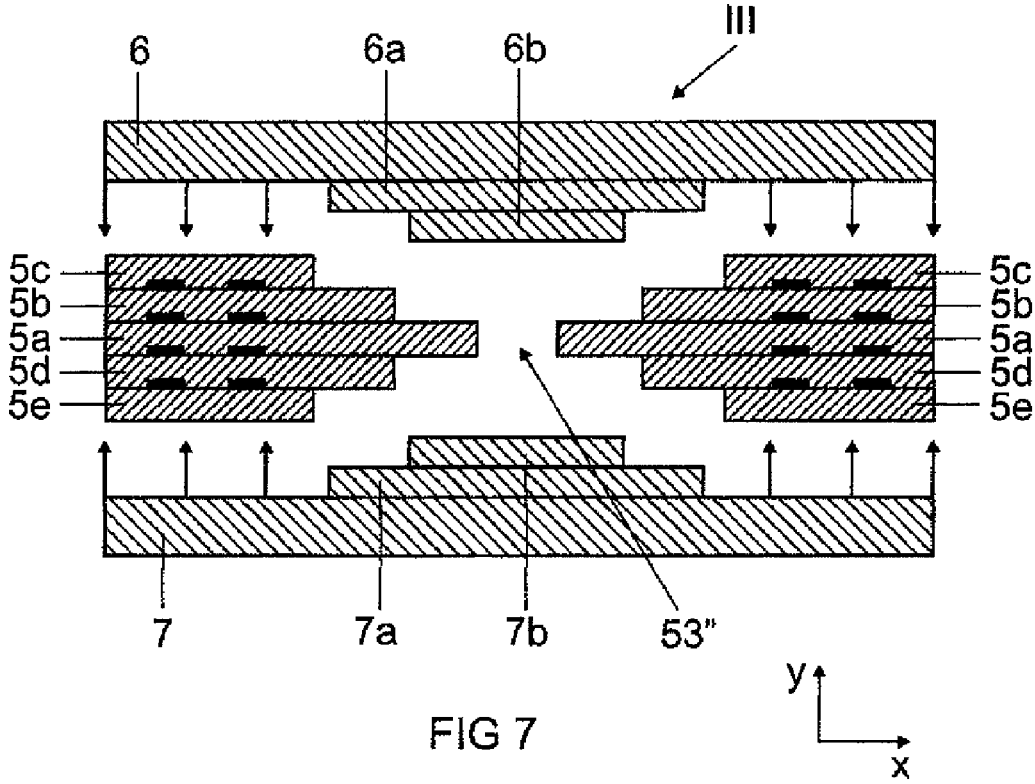
FIG. 7 shows a section illustration through a further exemplary embodiment of an inductive component according to the invention, which has not yet been completed.

FIG. 7 shows a further longitudinal section illustration through a planar transformer III, which is illustrated in a process stage in which it has not yet been completed. In this case as well, only one partial detail is shown, which illustrates the essential structure in a central area of the component.

The configuration and arrangement of the non-magnetic, dielectric ceramic layers 5*a* to 5*e* is analogous to the configuration shown in FIG. 6. Furthermore, FIG. 7 shows that the first magnetic ceramic layer 6, or a corresponding layer stack if appropriate, is provided with an additional structure which has the layers 6*a* and 6*b*. These layers 6*a* and 6*b* are formed from a magnetic material and, in the exemplary embodiment, are applied by means of screen printing in the form of a ferritic thick-film paste. As can be seen, these layers 6*a* and 6*b* are formed on that surface of the magnetic ceramic layer 6 which faces the dielectric ceramic layers 5*a* to 5*e*. These layers 6*a* and 6*b* are in the form of a stepped profile and are designed such that they are in the form of a complementary structure to the stepped configuration of the dielectric ceramic layers 5*c* and 5*b*.

Layers 7*a* and 7*b* are likewise arranged, analogously to this, on the second magnetic ceramic layer 7 or, if appropriate, a corresponding layer stack, are formed with a stepped profile and are in the form of a complementary structure with respect to the stepped profile which is produced by the dielectric ceramic layers 5*d* and 5*e*. The magnetic ceramic layers 6 and 7 are positioned in a subsequent process such that, as is illustrated in FIG. 7, the layers 6*a* and 6*b* as well as the layers 7*a* and 7*b* are arranged essentially in the area of the stepped profile, which is formed by the dielectric ceramic layers 5*a* to 5*b*. Before the final sintering process, these structures of the ceramic layers 6 and 7 are laminated onto the stack form of the dielectric ceramic layers 5*a* to 5*e* such that a cutout 53" is formed. This complementary structure of the ceramic layers 6 and 7 can be used to assist the formation, without any air gap, of a central area of the magnetic core of the planar transformer III.

Figure 8:
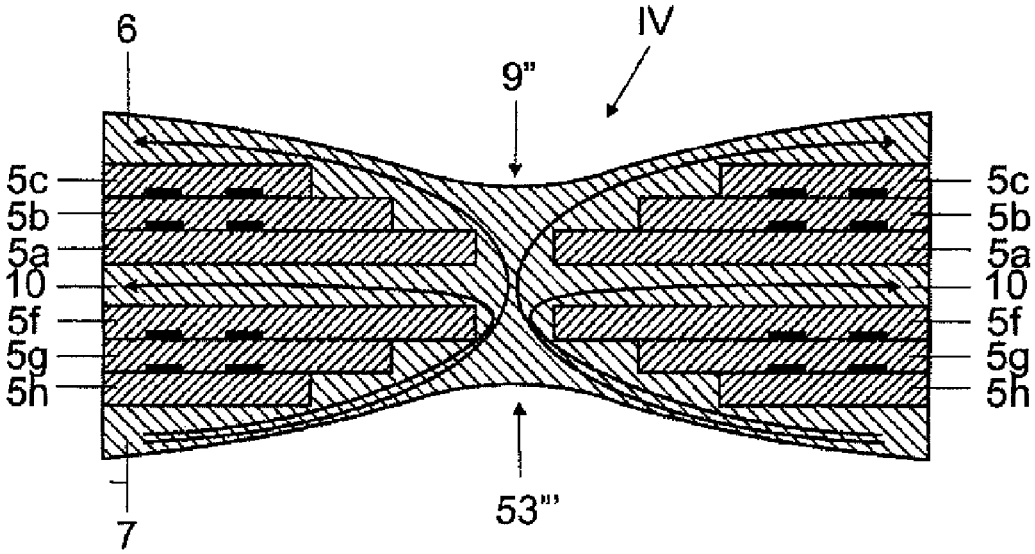
FIG. 8 shows a section illustration through a further exemplary embodiment of an inductive component according to the invention.

FIG. 8 shows a further longitudinal section illustration of a further exemplary embodiment of a monolithically integrated planar transformer IV. In this case, the planar transformer IV is illustrated in a completed state. As can be seen, an intermediate layer is formed between a dielectric ceramic layer 5*a* and a dielectric ceramic layer 5*f*, and is in the form of a further magnetic ceramic layer 10. Dielectric ceramic layers 5*a*, 5*b* and 5*c* as well as 5*f*, 5*g* and 5*h* which are in each case designed to be stacked and are stepped in the area of a cutout 53'", are arranged symmetrically with respect to this magnetic ceramic layer 10. A central area 9" of the magnetic core of the planar transformer IV is formed. This integration of a central magnetic ceramic layer 10, which once again may be a ferrite film, results in field lines of the primary winding (in the exemplary embodiment the turns which are arranged on the ceramic layers 5*g* and 5*h*) branching off before the secondary winding (turns which are arranged on the ceramic layers 5*a* and 5*b*), deliberately producing a stray inductance. The advantage of a deliberately produced stray inductance such as this is that no additional separate component is required in order to allow impedances to be adjusted individually. For example, in this case, the primary side may have an additional stray inductance which represents a further degree of freedom for the design of the circuitry of the component. In the illustrated embodiment, such deliberate adjustment can thus be made possible by means of an integrated configuration.

The invention claimed is:

1. A method for manufacturing an inductive component which is formed from a plurality of layers, wherein the method comprises the steps of:

a) arranging an electrically conductive material as a winding of the inductive component on a plurality of non-magnetic, dielectric ceramic layers;

b) forming at least one cutout which passes entirely through in the plurality of non-magnetic, dielectric ceramic layers;

c) arranging a first magnetic ceramic layer on an upper face and a second magnetic ceramic layer on a lower face of the plurality of non-magnetic, dielectric ceramic layers; and d) performing a process step in which at least one of the first and second magnetic ceramic layers is plastically deformed such that contact is made with the first and second magnetic ceramic layers in an area of the at least one cutout, and the first and second magnetic ceramic layers form a magnetic core of the component;

wherein the plurality of non-magnetic, dielectric ceramic layers are stacked, in each of which plurality of non-magnetic, dielectric ceramic layers the at the least one cutout is formed with different dimensions, and the plurality of non-magnetic, dielectric ceramic layers are stacked one on top of another such that cutouts of the plurality of non-magnetic, dielectric ceramic layers overlap, at least in places, where a cutout which passes through all the non-magnetic, dielectric ceramic layers is arranged to taper, at least in places.

2. The method as claimed in claim 1, wherein the electrically conductive material is embedded in or printed onto the plurality of non-magnetic, dielectric ceramic layers.

3. The method as claimed in claim 1, wherein the plurality of non-magnetic, dielectric ceramic layers and the magnetic ceramic layers are films.

4. The method as claimed in claim 1, wherein dimensions of the cutout on the plane of the plurality of non-magnetic, dielectric ceramic layers are greater than a thickness of the plurality of non-magnetic, dielectric ceramic layers formed according to step b).

5. The method as claimed in claim 1, wherein the first and second magnetic ceramic layers are laminated onto the upper face and the lower face of the plurality of non-magnetic, dielectric ceramic layers according to step c).

6. The method as claimed in claim 1, wherein a sintering process is performed according to step d).

7. The method as claimed in claim 1, wherein a coating is arranged at least on one magnetic ceramic layer during step d) to assist deformation of the at least one magnetic ceramic layer.

8. The method as claimed in claim 1, wherein a further non-magnetic, dielectric layer is applied to the electrically conductive material.

9. The method as claimed in claim 8, wherein the further non-magnetic, dielectric layer is a ceramic layer.

10. The method as claimed in claim 1, wherein a stepped profile is formed as the taper.

11. The method as claimed in claim 1, wherein a magnetic material is applied at least to one magnetic ceramic layer, with the first magnetic ceramic layer according to step c) being arranged on the plurality of non-Magnetic, dielectric ceramic layers such that the magnetic material is positioned in an area of the cutout.

12. The method as claimed in claim 11, wherein the magnetic material is applied with a structure which corresponds essentially to a complementary configuration of a tapered cutout.

13. The method as claimed in claim 11, wherein the magnetic material is printed on.

14. The method as claimed claim 1, wherein at least two non-magnetic, dielectric ceramic layers are formed, between which a magnetic layer is formed.

15. The method as claimed claim 14, wherein the magnetic layer is a ceramic layer.

16. The method as claimed in claim 1, wherein the electrically conductive material is formed on an upper face and a lower face of the plurality of non-magnetic, dielectric ceramic layers.

17. The method as claimed in claim 1, wherein the electrically conductive material is arranged to form a primary winding and a secondary winding of the inductive component.

18. The method as claimed in claim 1, wherein the plurality of non-magnetic, dielectric ceramic layers are formed with a thickness of between 20 μm and 200 μm.

19. The method as claimed in claim 18, wherein the plurality of non-magnetic, dielectric ceramic layers are formed with a thickness of between 50 μm and 100 μm.

20. The method as claimed in claim 1, wherein a monolithically integrated planar transformer is formed.

21. An inductive component which has a plurality of layers, comprising:

at least one electrically conductive winding of the component arranged on a plurality of non-magnetic, dielectric ceramic layers, in which at least one cutout which passes entirely through is formed; and a first magnetic ceramic layer arranged on an upper face, and a second magnetic ceramic layer formed on a lower face, of the plurality of non-magnetic dielectric ceramic layers, with at least one magnetic ceramic layer being plastically deformed in an area of the at least one cutout such that the at least one magnetic ceramic layer is connected to the other magnetic ceramic layer and a magnetic core of the component is formed;

wherein the plurality of non-magnetic, dielectric ceramic layers are stacked, in each of which plurality of non-magnetic ceramic, dielectric layers the at least one cutout is formed, with the plurality of non-magnetic, dielectric ceramic layers being arranged one on top of another such that cutouts of the plurality of non-magnetic, dielectric ceramic layers overlap, at least in places; and wherein the cutouts in respective ceramic layers have different dimensions and the plurality of non-magnetic, dielectric ceramic layers are stacked such that a cutout which passes through all the non-magnetic, dielectric ceramic layers is arranged to taper, at least in places.

22. The inductive component as claimed in claim 21, wherein windings are formed on the upper face and the lower face of the plurality of non-magnetic, dielectric ceramic layers.

23. The inductive component as claimed in claim 21, wherein dimensions of the cutout on a plane of the plurality of non-magnetic, dielectric ceramic layers are greater than a thickness of the plurality of non-magnetic, dielectric ceramic layers.

24. The inductive component as claimed in claim 21, wherein the taper is a stepped profile.

25. The inductive component as claimed in claim 21, wherein at least two non-magnetic, dielectric ceramic layers are formed, between which a magnetic layer is formed.

26. The inductive component as claimed in claim 25, wherein the magnetic layer is a ceramic layer.

* * * * *